United States Patent [19]

Bertini et al.

[11] Patent Number: 4,734,056

[45] Date of Patent: Mar. 29, 1988

[54] ELECTRICAL CONNECTOR FOR FLAT CABLE OR WIRE BUNDLES

[75] Inventors: Carlo Bertini; Aldo Bruni, both of Turin, Italy

[73] Assignee: AMP Incorporated, Harrisburg, Pa.

[21] Appl. No.: 6,289

[22] Filed: Jan. 20, 1987

Related U.S. Application Data

[63] Continuation of Ser. No. 716,899, Mar. 28, 1985, abandoned, which is a continuation-in-part of Ser. No. 591,352, Mar. 19, 1984, abandoned.

[51] Int. Cl.[4] ..... H01R/13/58

[52] U.S. Cl. ..... 439/460; 439/456; 174/153 G

[58] Field of Search ..... 339/206 R, 97 R, 97 P, 339/98, 99 R, 103 M, 105, 107, 92 M; 174/153 G; 439/449, 456, 460, 465, 733, 752

[56] References Cited

U.S. PATENT DOCUMENTS

| | | | |
|---|---|---|---|
| 3,054,081 | 9/1962 | Bertram et al. | 436/467 |
| 3,056,376 | 12/1974 | Polink et al. | 439/465 |
| 3,140,139 | 7/1964 | Urban | 339/210 M |
| 3,170,749 | 2/1965 | Johanson et al. | 339/107 |
| 3,994,555 | 11/1976 | Konno et al. | 339/103 R |
| 4,108,527 | 8/1978 | Douty et al. | 339/107 |
| 4,640,984 | 2/1987 | Kalbfeld | 339/107 |

FOREIGN PATENT DOCUMENTS

| | | |
|---|---|---|
| 0059566 | 9/1982 | European Pat. Off. . |
| 0080295 | 11/1982 | European Pat. Off. . |
| 1127429 | 4/1962 | Fed. Rep. of Germany . |
| 2146976 | 3/1973 | Fed. Rep. of Germany . |
| 3046062 | 6/1982 | Fed. Rep. of Germany . |
| 2520945 | 1/1982 | France . |

OTHER PUBLICATIONS

IBM Technical Disclosure Bulletin, vol. 25, No. 10, Mar. 1983, pp. 5374–5375.

*Primary Examiner*—Gil Weidenfeld
*Assistant Examiner*—Thomas M. Kline
*Attorney, Agent, or Firm*—William B. Noll

[57] ABSTRACT

An electrical connector comprises a housing having a pair of identical half-shells (12, 12') adapted to be clamped together to contain a terminal block (13) terminating individual conductors of a flat cable (15) (FIGS. 1, 3) or wire bundles (16) (FIGS. 2, 4, 5). A pair of conductor locating members (18, 18') have opposite faces (31, 32) formed respectively with hooked flat cable engaging ribs (24) and wire bundle receiving openings (34) for clamping flat cable (15) or receiving wire bundles (b 16) between them respectively. A rear wall (22) of each housing shell (12, 12') is provided with knock-outs (27, 27') removable to provide apertures for wire bundles (16).

9 Claims, 5 Drawing Figures

12
35
34'
15
32
34
36
18
35
13
33
38
33'
36
34
31
23
21
25'
27
34'
36'
18'
38'
17
26
27'
22
28
24
26'
25
14
20
23'
21'
12'

12
18
16
13
18'
17
12'

ELECTRICAL CONNECTOR FOR FLAT CABLE OR WIRE BUNDLES

This application is a continuation of application Ser. No. 716,899 filed Mar. 28, 1985, now abandoned, which is a continuation-in-part application of U.S. patent application Ser. No. 591,352 filed on Mar. 19, 1984 now abandoned.

The invention relates to an electrical connector including a housing adapted to accommodate elongate conductors grouped either as a flat cable or in bundles.

In the interests of economy, it is desirable that a requirement to house either a flat cable or a bundle of elongate conductors should be met in a single housing structure while avoiding a need to manufacture or store an inventory of different parts. At the same time, the connector housing should be adapted for application to either the flat cable or the wire bundle with only minimal manipulation in the field and yet provide strain relief as necessary in the particular environment of intended use.

U.S. Pat. No. 3,856,376 discloses an electrical connector for receiving, alternatively, conductors in groups of different sizes comprising an insulating housing including two shells each having a mating face and a conductor receiving face, a conductor locating member having first and second conductor locating faces of differing shapes, the conductor locating member being receivable between the housing shells when the shells are assembled together, in either of two positions in which first and second conductor locating faces extend, transversely of, and in locating engagement with, alternative groups of conductors extending through the conductor receiving face into the housing and terminated by terminals at the mating face.

However, a disadvantage of the prior connector is that it is relatively complex and time consuming to assemble in the field particularly as a clamping force sufficient for strain relief must be obtained by the application of a series of clamping screws during assembly of the housing shells about the conductors.

According to the invention, the connector is for receiving conductors grouped either as flat cable or a bundle, and comprises a second conductor locating member identical to the first, the first conductor locating faces each being formed with a cable engaging rib extending along only a first edge in a plane parallel to the conductor group, and the conductor locating members being locatable in the housing with the first faces adjacent and the first edges remote from each other so that the ribs are offset from each other spaced longitudinally of a flat cable located between the conductor locating members in a flat cable locating condition of the connector or with the second faces adjacent with the openings together defining a bundle receiving aperture in a bundle receiving condition of the connector.

The longitudinal stagger of the ribs in the assembly provides a non-linear path for the flat cable. Any tension causing straightening of the cable will tend, initially, to increase the engaging force between the cable and the locating members thereby increasing any strain relief. The ribs may also be hooked to improve such strain relief. Thus a requirement for clamping screws to apply the clamping force on the cable is obviated, facilitating assembly of the connector.

Preferably, a step is formed along a second edge of the second face spaced longitudinally of the cable from the rib.

The housing may comprise guides which locate the members for limited sliding movement toward and away from the flat cable whereby the flat cable is easily located between the members prior to final attachment of the housing shells together. This facilitates assembly of the connector housing shells together about the cable. The structure is particularly suitable for use in an environment subject to vibration.

In a particular example the guides comprise posts received in sockets formed in the locating members.

An example of an electrical connector according to the invention will now be described with reference to the accompanying drawings in which.

Figure 1:
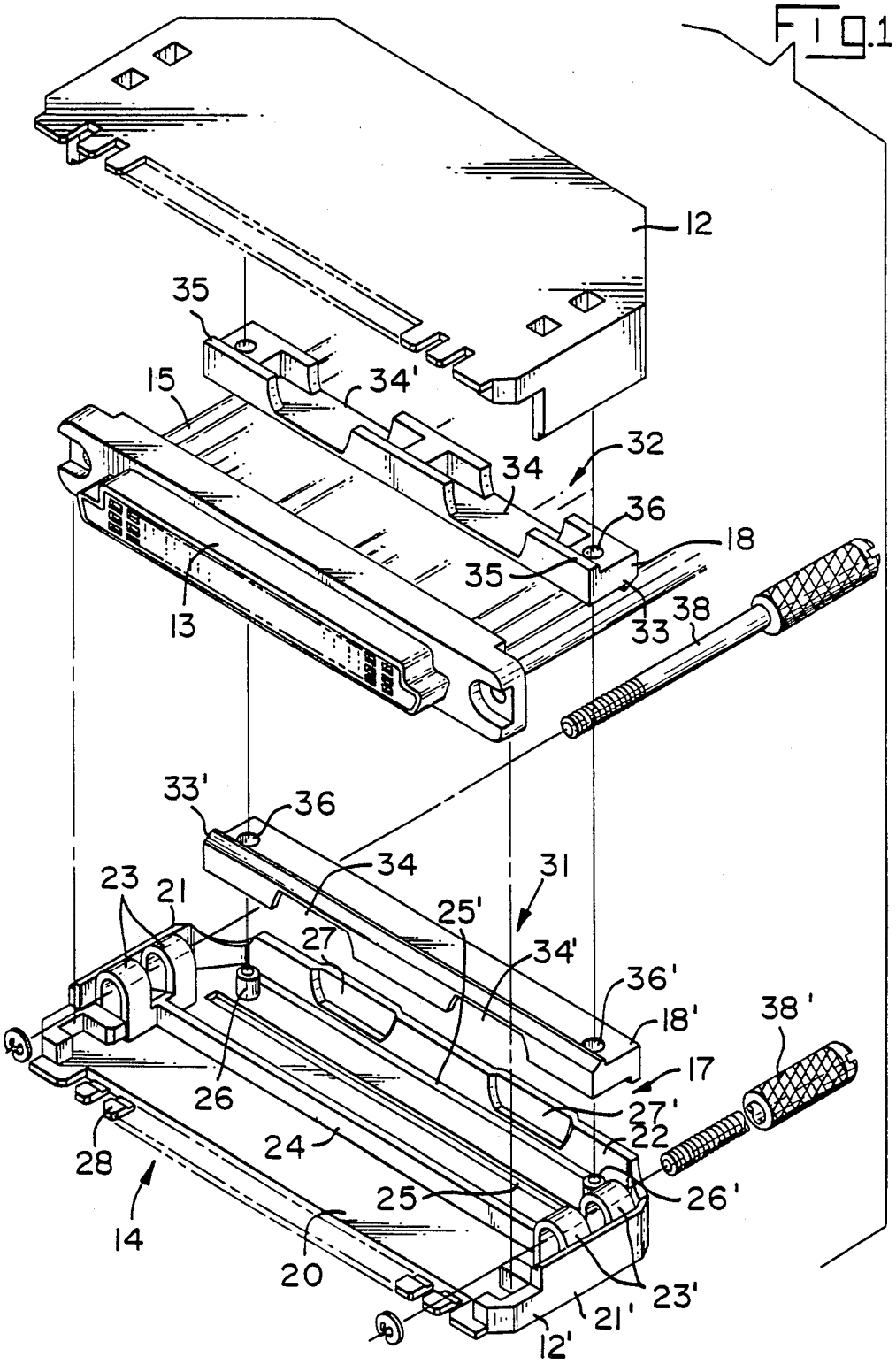
FIG. 1 is an exploded perspective view of the connector with conductor locating members aligned for locating engagement with a flat cable.

The connector comprises a pair of identical half-shells 12, 12' molded of plastics material and adapted to be secured together to provide a housing enclosing a terminal block 13 at a mating face and elongate conductors 15 or 16 (FIG. 2) terminated by terminals in the terminal block and extending through a conductor receiving face 17 of the housing with a pair of identical conductor locating members 18, 18' between the mating and conductor receiving faces in locating engagement with the conductors.

More specifically, each half-shell 12 comprises a base wall 20, side walls 21 and 21' upstanding from opposite edges of the base wall and rear wall 22 joining the side walls at the wire receiving face 17. Two pairs of fastening eyes 23 and 23' upstand from the base at its junction with the respective side walls, the eyes of one pair 23 being longitudinally staggered from the eyes 23' of the other pair and joined by a strengthening rib 24 which extends across the base wall. A pair of channels 25 and 25' extend in parallel relation across the base wall adjacent the rear wall and a pair of locating posts 26 and 26' upstand in spaced apart relation from the base wall between the channels 25 and 25'. The rear wall is formed with spaced-apart knock-outs 27 and 27' removable to provide bundle receiving apertures when the housing shells are assembled together.

The base wall is formed at the mating face with a series of polarising teeth 28 which can be selectively broken away to polarise the connector.

The conductor locating members 18 comprise first and second, opposite, flat cable and conductor bundle locating faces 31, 32 respectively. The first face is formed with a rib 33 along a first edge having a canted edge to define a hook. The second face is formed with a pair of spaced bundle receiving openings 34, 34' and a step 35 extending between the openings along a second edge of the second face spaced longitudinally (in the direction of the cable) from the rib 33. A pair of through sockets 36, 36' extend in spaced relation through the members.

Figure 3:
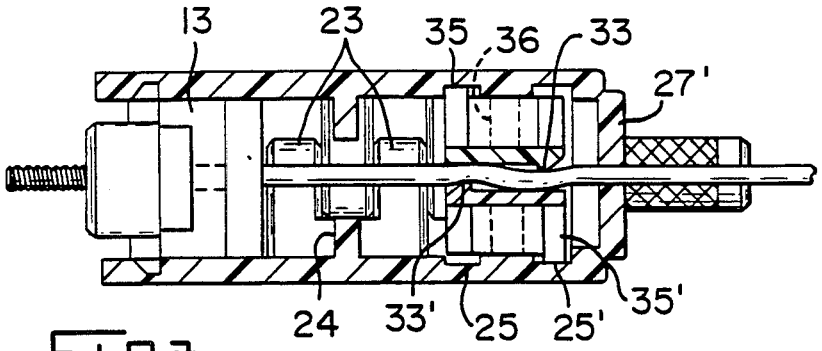
FIG. 3 is a cross-sectional view of the connector in the flat cable locating condition.

In assembling the connector to the flat cable 15, the terminal block is located in a half-shell adjacent the mating face 14 and the cable extending over a first face of cable locating member located in the half-shell by the posts 26, 26' being freely received in the sockets 36, 36'. The other half-shell is then assembled to the first with the other cable locating member similarly mounted on the posts, and the half-shells assembled together, eye pairs 23 of one shell interdigitating with eye pairs 23' of the other half-shell so that jackscrews 38, 38' can be threaded in locking engagement through both pairs on each side of the housing and secured by circlips as shown in FIG. 3. The steps 35, 35' are received in respective channels and the post 26, 26' received in respective sockets.

In this condition, the flat cable is clamped between the conductor locating members and, when in slack condition, the longitudinal offset of the hooked ribs and steps causes the cable to be non-linear. On imposing tension on the cable tending to straighten the cable, e.g., as a result of the vibration, initially, the cable is forced further against the hooked ribs increasing the clamping action.

Figure 2:
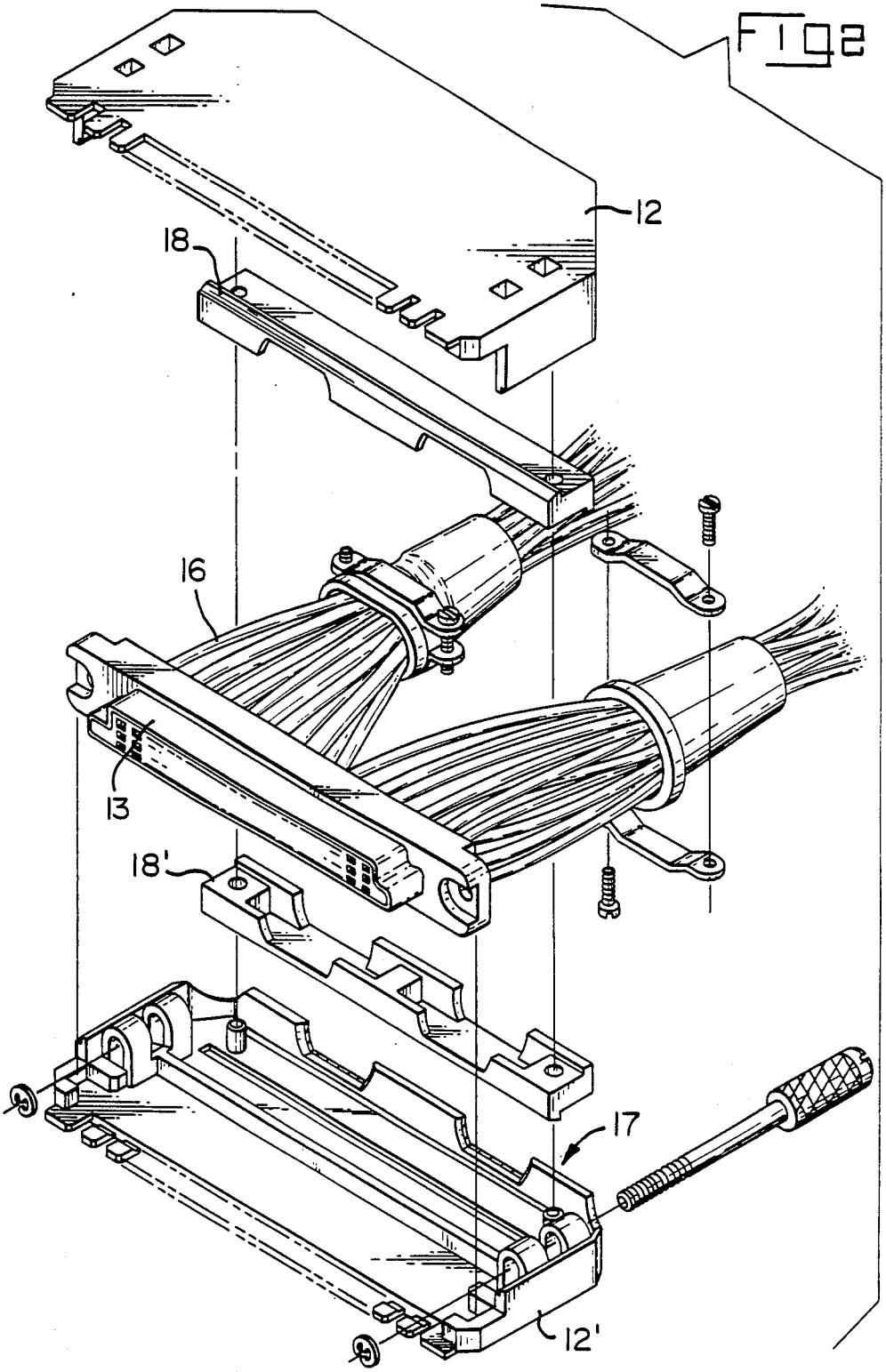
FIG. 2 is a similar view but with the conductor locating members aligned for engagement with a bundle of conductors.
Figure 4:
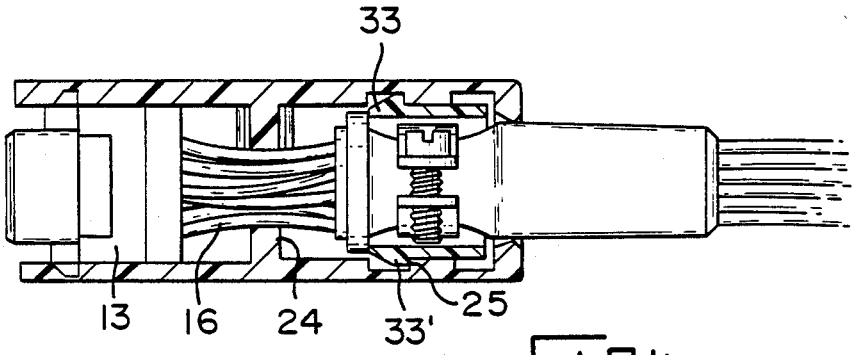
FIG. 4 is a similar view to FIG. 3 but with the connector in the bundle locating condition.
Figure 5:
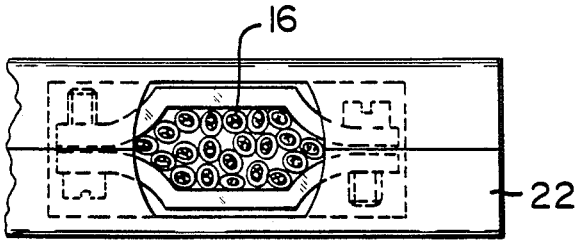
FIG. 5 is a fragmentary rear view of the connector in the bundle locating condition.

In assembling the connector to wire bundles, as shown in FIGS. 2, 4 and 5, the knock-outs 27, 27' are removed and the second faces of the conductor locating members arranged vertically adjacent about the bundles 16 which are clamped in boots and received in the cable receiving openings. In this condition, the hooked ribs engage the rearward edge of recess 25.

It will be apparent that the connector can rapidly be applied to either flat cable or wire bundles and that the essential parts are identical.

The connector is particularly adapted to mate with an upstanding printed circuit board post header formed with an elongate keyway for receiving a polarising key in a preselected longitudinal position corresponding with the location of a removed tooth.

What is claimed is:

1. An electrical connector for receiving, alternatively, conductors in groups of different sizes comprising an insulating housing including two shells (12, 12') each having a mating face (14) and a conductor receiving face (17), a conductor locating member (18) having first and second conductor locating faces (31, 32), of differing shapes, the conductor locating member (18 or 18') being receivable between the housing shells (12, 12') when the shells (12, 12') are assembled together, in either of two positions in which first and second conductor locating faces (31 and 32) extend, transversely of, and in locating engagement with, alternative groups of conductors extending through the conductor receiving face (17) into the housing (12, 12') and terminated by terminals at the mating face (14), characterized in that, the connector is for receiving conductors groups either as flat cable or a bundle, and comprises a second conductor locating member (18') identical to the first (18), the first conductor locating faces (31) each being formed with a cable engaging rib (33) extending along only a first edge thereof in a plane parallel to the conductor group, the housing shells (12, 12') being formed with guiding posts (26, 26') and the conductor locating members (18, 18') formed with sockets (36, 36'), the first and second conductor locating members (18, 18') being locatable in the housing (12, 12') by sliding receipt of the posts (26, 26') either with the first faces (31) adjacent and the first edges remote from each other so that the ribs (33) are offset from each other spaced longitudinally of a flat cable which is thereby trapped between the conductor locating members (18, 18') in a non-rectilinear manner in a flat cable locating condition of the connector or with the second faces (32) adjacent with the openings (34, 34') together defining a bundle receiving aperture in a bundle receiving condition of the connector.

2. An electrical connector according to claim 1, characterised in that the ribs (33) are canted to provide hooks and extend in opposite senses in the flat cable clamping condition.

3. An electrical connector according to claim 1, characterised in that the shells (12, 12') include fastening eyes (23, 23') located at respective opposite peripheries of the shells (12, 12') arranged to be brought into alignment with each other for the receipt of fastening rods (38, 38') extending between mating and rear faces of the shells (12, 12') to fasten together the shells (12, 12') assembled to the conductors and to a mating connector.

4. An electrical connector according to claim 1, characterised in that a pair of channels (25, 25') extend along each shell (12, 12') loated at equal spacing apart to the rib (33) and step (35) so that a channel (25) of each pair receives a step (35) when the conductor locating members (18, 18') are arranged in the flat cable receiving condition or a rib (33) when the conductor locating members (18, 18') are in the bundle receiving condition.

5. An electrical connector for receiving, alternatively, conductors in groups of different sizes comprising an insulating housing including two shells (12, 12') each having a mating face (14) and a conductor receiving face (17), a conductor locating member (18) having first and second conductor locating faces (31, 32), of differing shapes, the conductor locating member (18 or 18') being receivable between the housing shells (12, 12') when the shells (12, 12') are assembled together, in either of two positions in which first and second conductor locating faces (31 and 32) extend transversely of, and in locating engagement with, alternative groups of conductors extending through the conductor receiving face (17) into the housing (12, 12') and terminated by terminals at the mating face (14), characterised in that the connector is for receiving conductors grouped either as flat cable or a bundle, and comprises a second conductor locating member (18') identical to the first (18), the first conductor locating faces (31) each being formed with a cable engaging rib (33) extending along only a first edge thereof in a plane parallel to the conductor group, the first and second conductor locating members (18, 18') being locatable in the housing (12, 12') either with the first faces (31) adjacent and the first edges remote from each other so that the ribs (33) are offset from each other spaced longitudinally of a flat cable which is thereby trapped between the conductor locating members (18, 18') in a non-rectilinear condition in a flat cable locating condition of the connector or with the second faces (32) adjacent with the openings (34, 34') together defining a bundle receiving aperture in a bundle receiving condition of the connector, and a step (35) is formed along a second edge of the second face (32) spaced, longitudinally of the cable, from the rib (33), a pair of parallel channels (25) extending along each shell (12, 12') located at equal spacing apart to the rib (33) and step (35) so that a channel (25) of each pair receives a step (35) with the conductor locating members (18, 18') arranged in the flat cable receiving condition or a rib (33) with the conductor locating members (18, 18') in the bundle receiving condition.

6. An electrical connector according to claim 5, characterised in that the ribs (33) are canted to provide hooks and extend in opposite senses in the flat cable clamping condition.

7. An electrical connector according to claim 5, characterised in that the housing shells (12, 12') are formed with guiding posts (26, 26') located between the channels (25) of the respective pairs of channels and the conductor locating members (18, 18') are formed with sockets (36, 36'), receiving the respective posts (26, 26') as a sliding fit to mount the conductor locating members (18, 18') in either condition.

8. An electrical connector according to claim 5, characterised in that the shells (12, 12') include fastening eyes (23, 23') located at respective opposite peripheries of the shells (12, 12') arranged to be brought into alignment with each other for the receipt of fastening rods (38, 38') extending between mating and rear faces of the shells (12, 12') to fasten together the shells (12, 12') assembled to the conductors and to a mating connector.

9. An electrical connector for receiving, alternatively, conductors in groups of different sizes, comprising an insulating housing including two shells (12,12') each having a mating face (14) and a conductor receiving face (17), first and second conductor locating members (18 and 18' respectively) each having first and second conductor locating faces (31,32), of differing shapes, the first conductor locating faces (31) each being formed with a conductor engaging rib (33) and the second conductor locating faces (32) each being formed with a conductor receiving opening (34 or 34'), the conductor locating members (18 or 18') being receivable between the housing shells (12,12') when the shells (12,12') are assembled together, in either of two positions according to the size of the conductor group, where in both positions the first and second conductor locating faces (31 and 32) extends transversely of, and in locating engagement with, alternative groups of conductors extending through the conductor receiving face (17) into the housing shells (12,12') and terminated by terminals at the mating face (14), characterized in that the connector is for receiving conductors groups of a flat cable, and the second conductor locating member (18') is identical to the first (18), the conductor engaging rib (33) extending along only a first edge thereof such that, in the first position, the conductor locating members (18,18') are locatable in the housing shells (12,12') with the first edges remote from each other so that the ribs (33) are offset from each other spaced longitudinally of a flat cable located between the conductor locating members (18,18') to clamp the flat cable in non-rectilinear condition, and that the housing shells (12,12') include fastening eyes (23,23') located at respective opposite peripheries of the housing shells (12,12') arranged to be brought into alignment with each other for the receipt of fastening rods (38,38') extending between mating and rear faces of the housing shells (12,12') to fasten together the housing shells (12,12') assembled to the conductors and to a mating connector.

* * * * *